US011501696B2

(12) United States Patent
Wu et al.

(10) Patent No.: US 11,501,696 B2
(45) Date of Patent: Nov. 15, 2022

(54) PIXEL DRIVING DEVICE AND METHOD FOR DRIVING PIXEL

(71) Applicant: AU Optronics Corporation, Hsin-Chu (TW)

(72) Inventors: Chia-En Wu, Hsin-Chu (TW); Ming-Hsien Lee, Hsin-Chu (TW); Wei-Chia Chiu, Hsin-Chu (TW); Kuan-Yu Chen, Hsin-Chu (TW); Chia-Yen Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/320,413

(22) Filed: May 14, 2021

(65) Prior Publication Data

US 2022/0036809 A1 Feb. 3, 2022

(30) Foreign Application Priority Data

Jul. 31, 2020 (TW) ..... 109126105

(51) Int. Cl.
*G09G 3/32* (2016.01)

(52) U.S. Cl.
CPC ..... *G09G 3/32* (2013.01); *G09G 2300/0842* (2013.01); *G09G 2310/061* (2013.01); *G09G 2320/064* (2013.01); *G09G 2330/028* (2013.01)

(58) Field of Classification Search
None
See application file for complete search history.

(56) References Cited

U.S. PATENT DOCUMENTS

2018/0151123 A1* 5/2018 Li ..... H01L 51/5203
2019/0371238 A1 12/2019 Gao et al.
2020/0226974 A1 7/2020 Cheng et al.
2021/0233469 A1* 7/2021 Chen ..... G09G 3/3233

FOREIGN PATENT DOCUMENTS

CN 109887466 A 6/2019
CN 110619843 A 12/2019

* cited by examiner

*Primary Examiner* — Chad M Dicke
(74) *Attorney, Agent, or Firm* — WPAT, PC

(57) ABSTRACT

A pixel driving device includes a capacitance, a reset circuit, a compensation circuit, a driving transistor and a first transistor. Reset circuit and compensation circuit are coupled to a first end and a second end of capacitance. First transistor is coupled between second end of driving transistor and second end of capacitance. Reset circuit resets first end of capacitance at a power supply voltage and reset second end of capacitance at a reference voltage according to a first sweep signal respectively. Compensation circuit writes a data voltage into first end of capacitance via driving transistor and second end of capacitance is maintained at reference voltage according to a second sweep signal. First transistor generates a driving voltage difference between first end and second end of capacitance according to a control signal. Driving transistor outputs a current to a luminous element according to driving voltage difference.

10 Claims, 7 Drawing Sheets

PIXEL DRIVING DEVICE AND METHOD FOR DRIVING PIXEL

CROSS-REFERENCE TO RELATED APPLICATION

This application claims priority to Taiwan Application Serial Number 109126105, filed on Jul. 31, 2020, which is herein incorporated by reference in its entirety.

BACKGROUND

Field of Invention

The present disclosure relates to display device and method. More particularly, the present disclosure relates to a pixel driving device and a method for driving pixel.

Description of Related Art

Micro light emitting device (pLED) features a high luminance under a high driving current. Therefore, in a conventional structure of a driving circuit, an internal threshold voltage of driving transistor will generate a difference under different situations. Under a higher driving current, an impedance of a driving circuit will generate a difference in a power supply voltage. An internal threshold voltage of driving transistor and an impedance of a driving circuit both affect a driving current so as to generate a difference in luminance of micro light emitting device.

For the foregoing reason, there is a need to provide other suitable methods for driving pixels and circuits to solve the problems of the prior art.

SUMMARY

One aspect of the present disclosure provides a pixel driving device. The pixel driving device includes a capacitor, a reset circuit, a compensation circuit, a driving transistor and a first transistor. The capacitor includes a first end and a second end. The reset circuit is coupled to the first end and the second end of the capacitor. The compensation circuit is coupled to the first end and the second end of the capacitor. The driving transistor includes a first end, a second end and a control end. The control end of the driving transistor is coupled to the first end of the capacitor. The first transistor includes a first end, a second end, and a control end. Each of The first end and the second end of the first transistor is coupled between the second end of the driving transistor and the second end of the capacitor. The reset circuit is configured to reset the first end of the capacitor to a power supply voltage and reset the second end of the capacitor to a reference voltage according to a first sweep signal respectively in a first stage. The compensation circuit is configured to write a data voltage into the first end of the capacitor via the driving transistor so that a voltage of the first end of the capacitor is at a first voltage and the second end of the capacitor is maintained at the reference voltage according to a second sweep signal in a second stage. The first transistor is configured to turn on so as to generate a driving voltage difference between the first voltage of the first end of the capacitor and the reference voltage of the second end of the capacitor according to a control signal in a third stage. The driving transistor is configured to output a driving current to a luminous element according to the driving voltage difference in the third stage.

Another aspect of the present disclosure provides a method for driving pixel. The method for driving pixel is adapted for a pixel driving device. The pixel driving device includes a capacitor, a driving transistor and a first transistor. A control end of the driving transistor is coupled to a first end of the capacitor. Each of a first end and a second end of the first transistor is coupled to a second end of the capacitor and a second end of the driving transistor respectively. The method for driving pixel includes: resetting the first end of the capacitor to a power supply voltage and resetting the second end of the capacitor to a reference voltage according to a first sweep signal respectively in a first stage; writing a data voltage into the first end of the capacitor so that a voltage of the first end of the capacitor is at a first voltage and the second end of the capacitor is maintained at the reference voltage via the driving transistor according to a second sweep signal in a second stage; turning on to generate a driving voltage difference between the first voltage of the first end of the capacitor and the reference voltage of the second end of the capacitor according to a control signal in a third stage; and outputting a driving current to a luminous element according to the driving voltage difference in the third stage.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
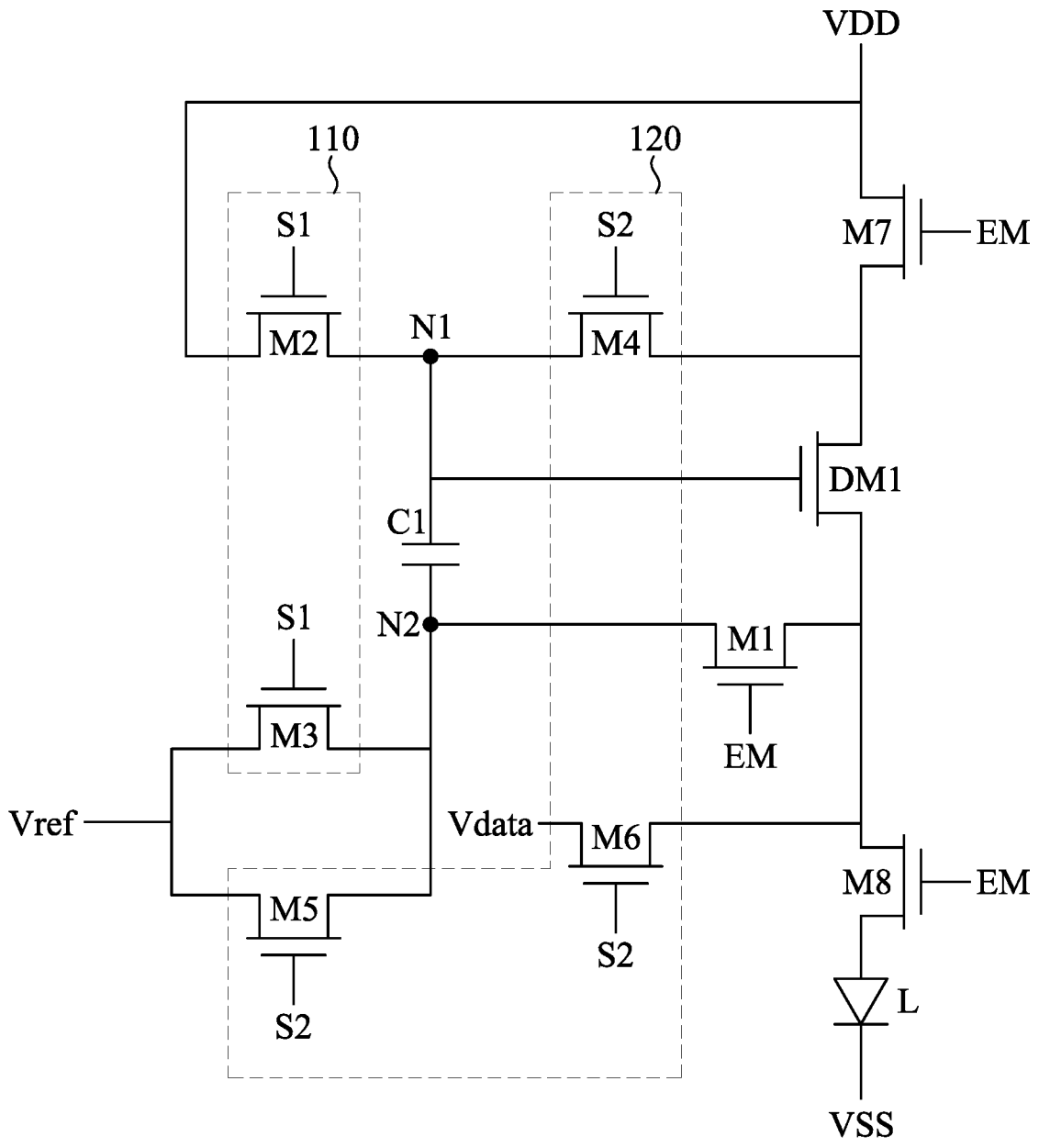
FIG. 1 depicts a schematic diagram of a pixel driving device according to some embodiments of the present disclosure.

Reference will now be made in detail to the present embodiments of the invention, examples of which are illustrated in the accompanying drawings. Wherever possible, the same reference numbers are used in the drawings and the description to refer to the same or like parts.

The terminology used herein is for the purpose of describing particular example embodiments only and is not intended to be limiting of the present disclosure. As used herein, the singular forms "a," "an" and "the" are intended to include the plural forms as well, unless the context clearly indicates otherwise.

Furthermore, it should be understood that the terms, "comprising", "including", "having", "containing", "involving" and the like, used herein are open-ended, that is, including but not limited to.

The terms used in this specification and claims, unless otherwise stated, generally have their ordinary meanings in the art, within the context of the disclosure, and in the specific context where each term is used. Certain terms that are used to describe the disclosure are discussed below, or elsewhere in the specification, to provide additional guidance to the practitioner skilled in the art regarding the description of the disclosure.

FIG. 1 depicts a schematic diagram of a pixel driving device according to some embodiments of the present disclosure. In some embodiments, as shown in FIG. 1, a pixel driving device 100 includes a reset circuit 110, a compensation circuit 120, a capacitor C1, a driving transistor DM1, a first transistor M1, and a luminous element L. In some embodiments, a display device (not shown in figure) includes a plurality of pixels. Each of the pixels includes at least one pixel driving device 100. In some embodiments, the pixel driving device 100 further includes a seventh transistor M7 and an eighth transistor M8. In some embodiments, the luminous element L includes one of a micro Light Emitting Diode (μLED) and an organic light emitting diode (OLED).

In some embodiments, the capacitor C1 includes a first end N1 and a second end N2. The reset circuit 110 is coupled to the first end N1 and the second end N2 of the capacitor C1. The compensation circuit 120 is coupled to the first end N1 and the second end N2 of the capacitor C1. The driving transistor DM1 includes a first end, a second end, and a control end. The control end of the driving transistor is coupled to the first end N1 of the capacitor C1. The first transistor M1 includes a first end, a second end, and a control end. Each of the first end and the second end of the first transistor M1 is coupled between the second end of the driving transistor DM1 and the second end N2 of the capacitor C1.

Figure 2:
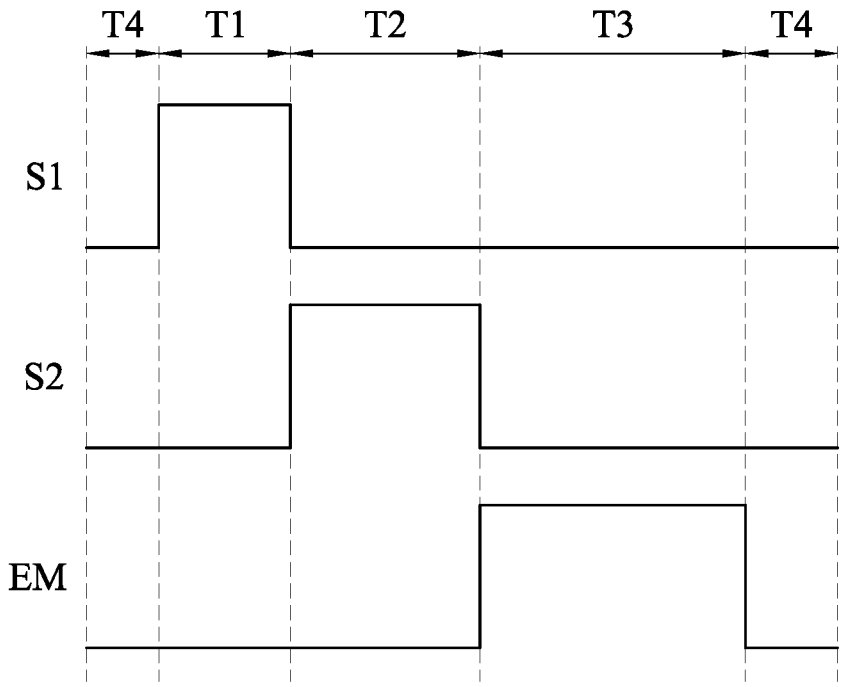
FIG. 2 depicts a timing diagram of signals of a method for driving pixel according to some embodiments of the present disclosure.

In some embodiments, in order to facilitate the understanding of an operation of the pixel driving device 100, please refer to FIG. 1 and FIG. 2 together. FIG. 2 depicts a timing diagram of signals of a method for driving pixel according to some embodiments of the present disclosure. The reset circuit 110 is configured to reset the first end N1 of the capacitor C1 to a power supply voltage VDD and reset the second end N2 of the capacitor C1 to a reference voltage Vref respectively according to a first sweep signal S1 in a first stage T1. The compensation circuit 120 is configured to write a data voltage Vdata into the first end N1 of the capacitor C1 via the driving transistor DM1according to a second sweep signal S2 in a second stageT2 so that a voltage of the first end N1 capacitor C1 is at a first voltage and the second end of the capacitor C1 is maintained at the reference voltage Vref. The first transistor M1 is configured to turn on according to a control signal EM so as to generate a driving voltage difference between the first voltage of the first end N1 of the capacitor C1 and the reference voltage Vref of the second end N2 of the capacitor C1 in a third stage T3. The driving transistor DM1 is configured to output a driving current to the luminous element L according to the driving voltage difference in the third stage T3.

In some embodiments, in order to facilitate the understanding of detail elements of the reset circuit 110 shown in FIG. 1, please refer to FIG. 1 and FIG. 2 together, and start form a top end and a right end of each of an element shown in the figure as a first end. The reset circuit 110 includes a second transistor M2 and a third transistor M3. In some embodiments, the second transistor M2 includes a first end, a second end, and a control end. The first end of the second transistor M2 is electrically connected to the first end N1 of the capacitor C1. The second end of the second transistor M2 is configured to receive the power supply voltage VDD. The control end of the second transistor M2 is configured to reset the first end N1 of the capacitor C1 to the power supply voltage VDD according to the first sweep signal S1 in the first stage T1.

In addition, the third transistor M3 includes a first end, a second end, and a control end. The first end of the third transistor M3 is electrically connected to the second end N2 of the capacitor C1. The second end of the third transistor M3 is configured to receive the reference voltage Vref. The control end of the third transistor M3 is configured to reset the second end N2 of the capacitor C1 to the reference voltage Vref according to the first sweep signal S1 in the first stage T1.

In some embodiments, in order to facilitate the understanding of detail elements of the compensation circuit 120 shown in FIG. 1, please refer to FIG. 1 and FIG. 2 together, and start form a top end and a right end of each of an element shown in the figure as a first end. The compensation circuit 120 includes a fourth transistor M4, a fifth transistor M5, and a sixth transistor M6. In some embodiments, the fourth transistor M4 includes a first end, a second end, and a control end. The first end of the fourth transistor M4 is electrically connected to the first end of the driving transistor DM1. The second end of the fourth transistor M4 is electrically connected to the first end N1 of the capacitor C1. The control end of the fourth transistor M4 is configured to write the data voltage Vdata into the first end N1 of the capacitor C1 via driving transistor DM1 according to the second sweep signal S2 in the second stageT2.

In addition, the fifth transistor M5 includes a first end, a second end, and a control end. The first end of the fifth transistor M5 is electrically connected to the second end N2 of the capacitor C1. The second end of the fifth transistor M5 is configured to receive the reference voltage Vref. The control end of the fifth transistor M5 is configured to maintain the second end N2 of the capacitor C1 at the reference voltage Vref according to the second sweep signal S2 in the second stage T2.

Moreover, the sixth transistor M6 includes a first end, a second end, and a control end. The first end of the sixth transistor M6 is electrically connected to the second end of the driving transistor DM1. The second end of the sixth transistor M6 is configured to receive the data voltage Vdata. The control end of sixth transistor M6 is configured to write the data voltage Vdata into the first end N1 of the capacitor C1 via the driving transistor DM1 according to the second sweep signal S2 in the second stage T2. The luminous element L includes a first end and a second end. The first end of the luminous element L is electrically connected to the second end of the driving transistor DM1. The second end of the luminous element L is configured to receive a power supply voltage VSS. In some embodiments, the second end of the luminous element L is electrically connected to the first end of the driving transistor DM1, and the first end of the luminous element L is configured to receive the power supply voltage VDD via driving transistor DM1.

In some embodiments, each of the seventh transistor M7 and the eighth transistor M8 is configured to turn on so as to output the driving current to the luminous element L according to the control signal EM in the third stage T3. In some embodiments, the seventh transistor M7 includes a first end, a second end, and a control end. The first end of the seventh transistor M7 is configured to receive the power supply voltage VDD. The second end of the seventh transistor M7 is electrically connected to the first end of the driving transistor DM1. The control end of the seventh transistor M7 is configured to turn on so as to output the driving current to the luminous element L according to the control signal EM in the third stage T3.

In addition, the eighth transistor M8 includes a first end, a second end, and a control end. The first end of the eighth transistor M8 is electrically connected to the second end of the driving transistor DM1. The second end of the eighth transistor M8 is electrically connected to the luminous element L. The control end of the eighth transistor M8 is configured to turn on so as to output the driving current to the luminous element L according to the control signal EM in the third stage T3.

In some embodiments, the control signal EM includes a pulse width modulation signal. A duty cycle of the pulse width modulation signal is adjustable so as to control the luminance of the luminous element L.

Figure 3:
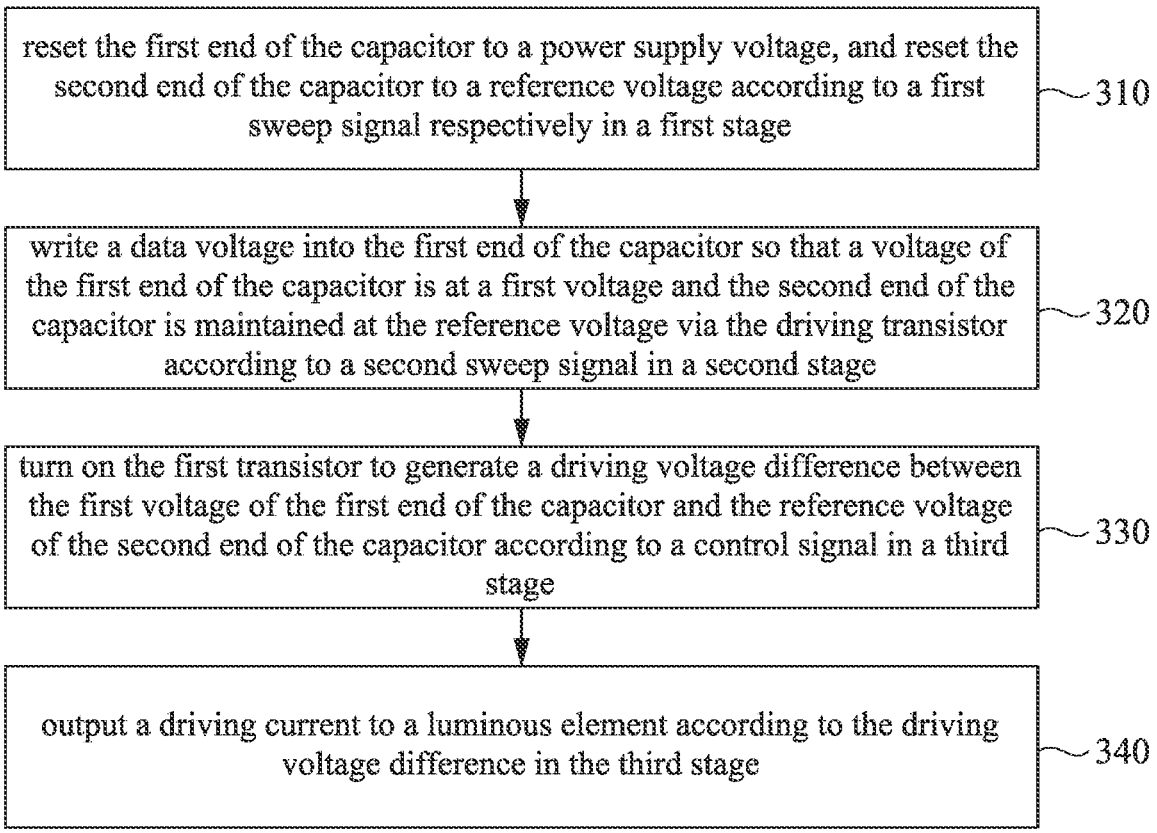
FIG. 3 depicts a flow diagram of a method for driving pixel according to some embodiments of the present disclosure.

FIG. 3 depicts a flow diagram of a method for driving pixel according to some embodiments of the present disclosure. In some embodiments, the method for driving pixel 300 can be implemented by the pixel driving device 100. In order to facilitate the understanding of an operation of the method for driving pixel 300 shown in FIG. 3, please refer to FIG. 3 to FIG. 7. FIG. 4 to FIG.7 depict a state diagram of a pixel driving device according to some embodiments of the present disclosure, correspond to the pixel driving device 100 shown in Fig.1.

The step 310 is performed to reset the first end of the capacitor to a power supply voltage and reset the second end of the capacitor to a reference voltage according to a first sweep signal respectively in a first stage.

Figure 4:
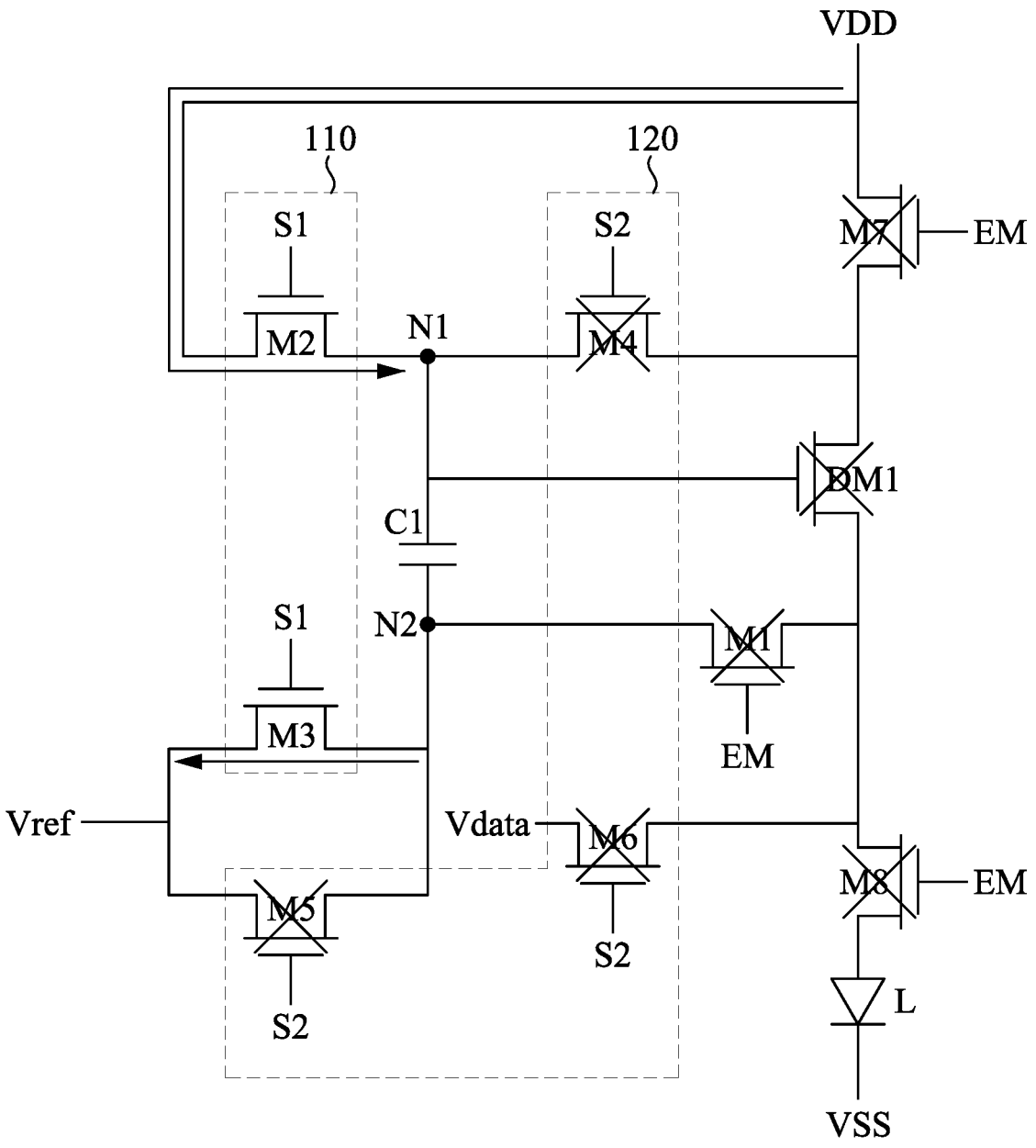
FIG. 4 depicts a state diagram of a pixel driving device according to some embodiments of the present disclosure.

In some embodiments, please refer to FIG. 2, FIG. 3, and FIG. 4, in the first stage T1, the first sweep signal S1 is at a high level, and the reset circuit 110 turns on according to the first sweep signal S1. In some embodiments, in the first stage T1, the second transistor M2 of the reset circuit 110 turns on according to the first sweep signal S1, and the second end of the second transistor M2 is configured to receive and transmit the power supply voltage VDD to the first end N1 of the capacitor C1 so as to reset the first end N1 of the capacitor C1 at the power supply voltage VDD. At this time, a potential of the first end N1 of the capacitor C1 is at the power supply voltage VDD.

In addition, in the first stage T1, the third transistor M3 of the reset circuit 110 turns on according to the first sweep signal S1, and the second end of the third transistor M3 is configured to receive and transmit the reference voltage Vref to the second end N2 of the capacitor C1 so as to reset the second end N2 of capacitor C1 at the reference voltage Vref. At this time, a potential of the second end N2 of the capacitor C1 is at the reference voltage Vref.

Moreover, the rest signals are at low level, therefore, the rest circuits of the pixel driving device 100 are turned off.

The step 320 is performed to write a data voltage into the first end of the capacitor so that a voltage of the first end of the capacitor is at a first voltage, and the second end of the capacitor is maintained at the reference voltage via the driving transistor according to a second sweep signal in a second stage.

Figure 5:
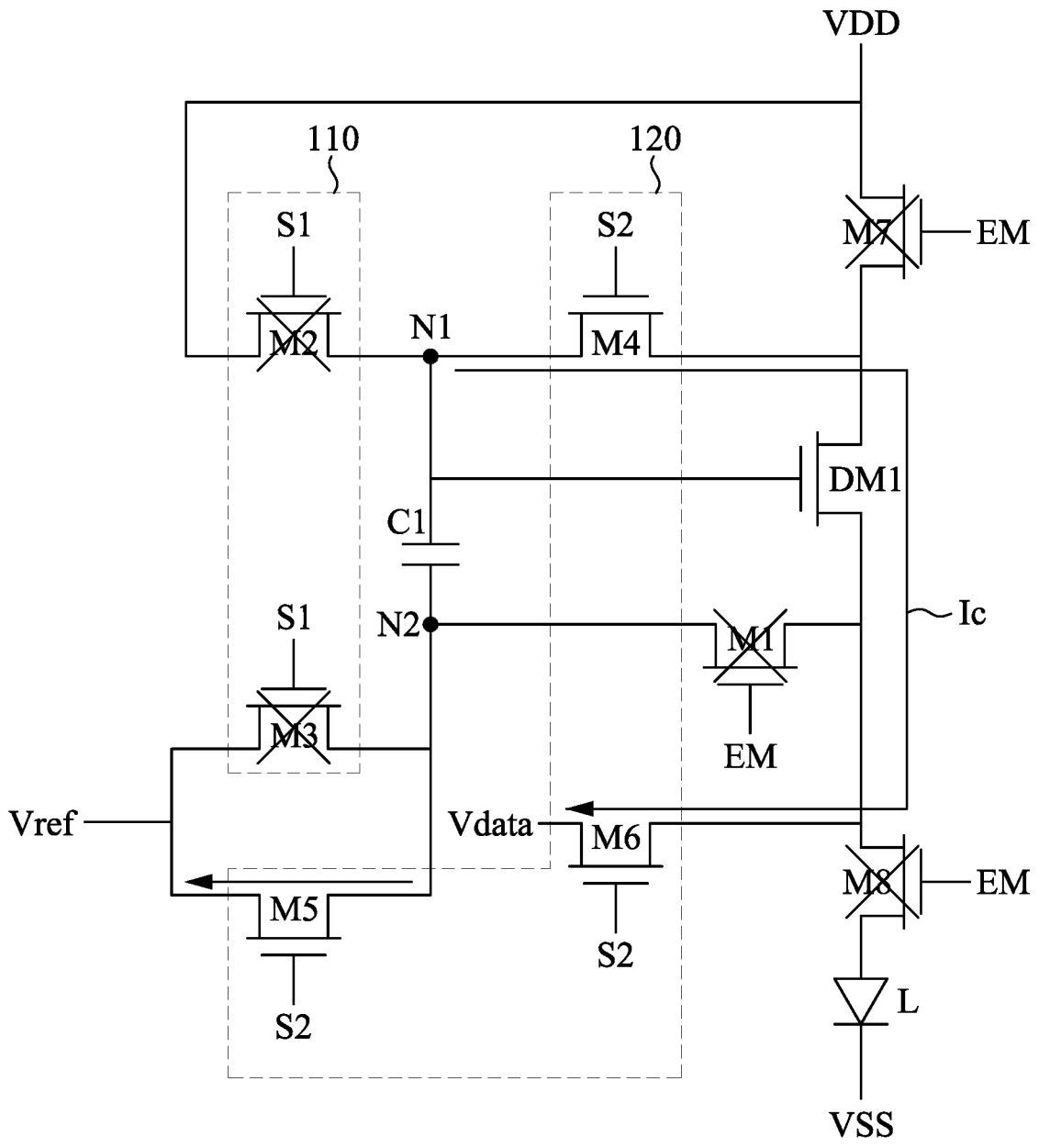
FIG. 5 depicts a state diagram of a pixel driving device according to some embodiments of the present disclosure.

In some embodiments, please refer to FIG. 2, FIG. 3, and FIG. 5, in the second stage T2, the second sweep signal S2 is at high level, the compensation circuit 120 is turned on according to the second sweep signal S2. In some embodiments, in the second stage T2, the fifth transistor M5 of the compensation circuit 120 is turned on according to the second sweep signal S2, the second end of the fifth transistor M5 is configured to receive and transmit the reference voltage Vref. Because the rest signals are at low signal, the reset circuit 110 and the first transistor M1 are turned off, and do not affect the fifth transistor M5. The fifth transistor M5 can maintain the second end N2 of the capacitor C1 at a potential which is rest in the first stage T1. At this time, a potential of the second end N2 of the capacitor C1 is still at the reference voltage Vref.

In addition, in the second stage T2, the fourth transistor M4 and the sixth transistor M6 of the compensation circuit 120 are turned on according to the second sweep signal S2. At the same time, the driving transistor DM1 is turned on according to a potential of the first end N1 of the capacitor C1. The driving transistor DM1, the fourth transistor M4, and the sixth transistor M6 form a path to generate a compensation current Ic. The second end of the sixth transistor M6 is configured to receive the data voltage Vdata, and compensate the first end N1 of the capacitor C1 at the first voltage via the driving transistor DM1. At this time, a potential of the first end N1 of the capacitor C1 is at the first voltage, and the first voltage is the data voltage Vdata plus a threshold voltage Vth of the driving transistor DM1.

The step 330 is performed to turn on the first transistor to generate a driving voltage difference between the first voltage of the first end of the capacitor and the reference voltage of the second end of the capacitor according to a control signal in a third stage.

Figure 6:
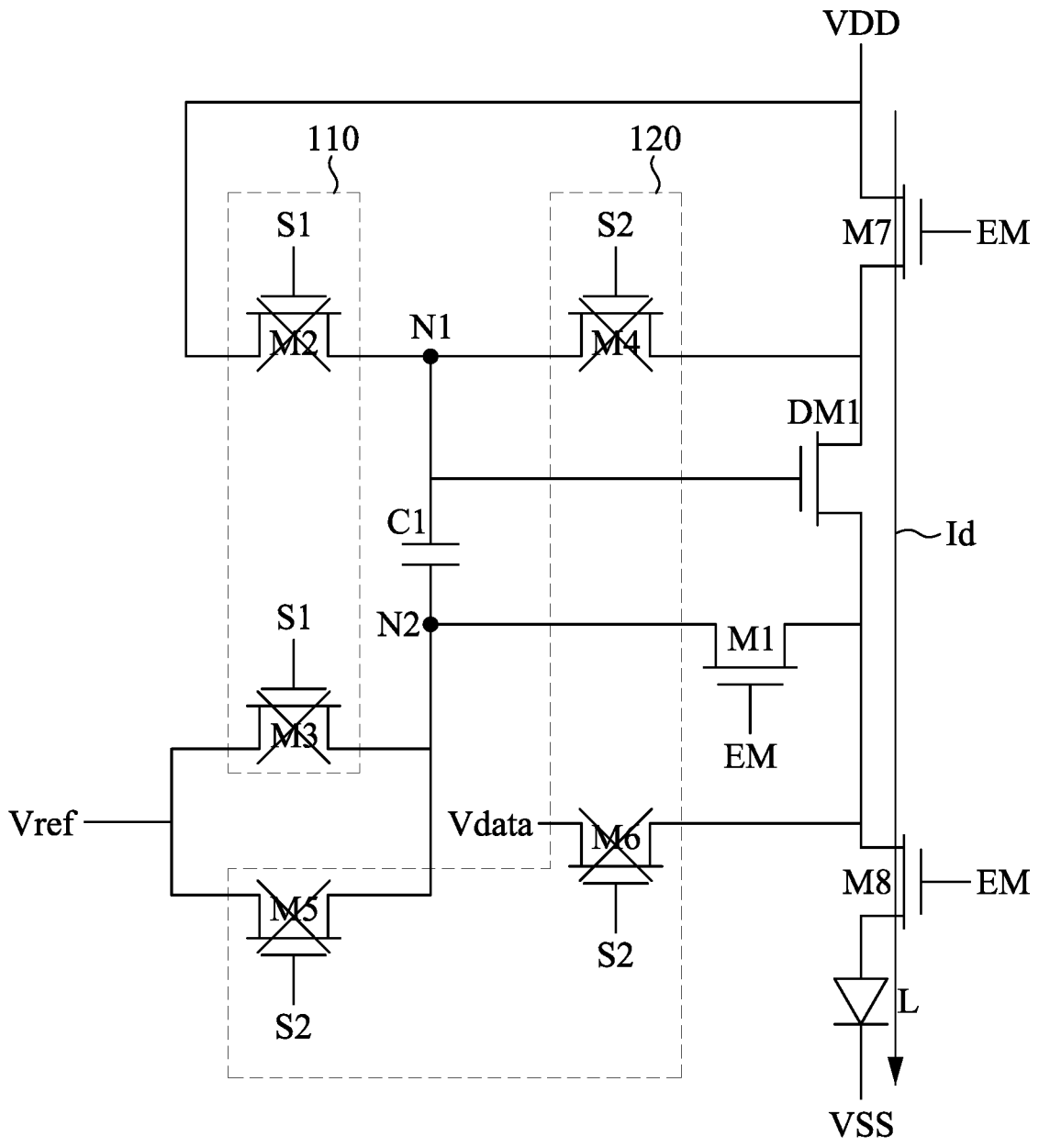
FIG. 6 depicts a state diagram of a pixel driving device according to some embodiments of the present disclosure.

In some embodiments, please refer to FIG. 2, FIG. 3, and FIG. 6, in the third stage T3, the control signal EM is at high level, the first transistor M1, the seventh transistor M7, and the eighth transistor M8 are turned on according to the control signal EM. A potential which the first transistor M1 is coupled to the second end N2 of the capacitor C1 is changed from the reference voltage Vref to a potential Vled the luminous element L, and the first voltage of the first end N1 of the capacitor C1 responds to a potential of the second end N2 of the capacitor C1. At this time, a potential of the first end N1 of the capacitor C1 rises from the first voltage (Vdata+Vth) to (Vdata+Vth−Vref+Vled).

The step 340 is performed to output a driving current to a luminous element according to the driving voltage difference in the third stage.

In some embodiments, please refer to FIG. 2, FIG. 3, and FIG. 6, the driving transistor DM1 outputs the driving current Id to the luminous element L according to the driving voltage difference between the control end and the second end of the driving transistor DM1.The driving voltage difference between the control end and the second end of the driving transistor DM1 is equal to a voltage difference between the first end N1 of the capacitor C1 and the second end N2 of the capacitor C1. A formula of the aforementioned driving current Id is listed below:

$$Id=K(VGS-Vth)^2 \quad \text{formula 1}$$

In formula 1, Id is a driving current, VGS is a voltage difference between the control end of the driving transistor DM1 and the second end of the driving transistor DM1, and Vth is a threshold voltage. In the third stage, a potential of the control end of the driving transistor DM1 is at (Vdata+Vth−Vref+Vled), and a potential of the second end of the driving transistor DM1 is at Vled. The potential of the second end of the driving transistor DM1 and the potential of the control end of the driving transistor DM1 are substituted into formula 1, and a new formula is obtained below:

$$Id=K(V\text{data}-V\text{ref})^2 \quad \text{formula 2}$$

Based on formula 2, the pixel driving device of the present disclosure cooperates with a suitable method for driving pixel so as to eliminate the threshold voltage Vth of the driving transistor DM1. In addition, the driving current Id depends on a difference between the data voltage Vdata and the reference voltage Vref. The driving current Id is independent of the power supply voltage VDD/VSS, and is unaffected under the power supply voltage VDD/VSS.

Figure 7:
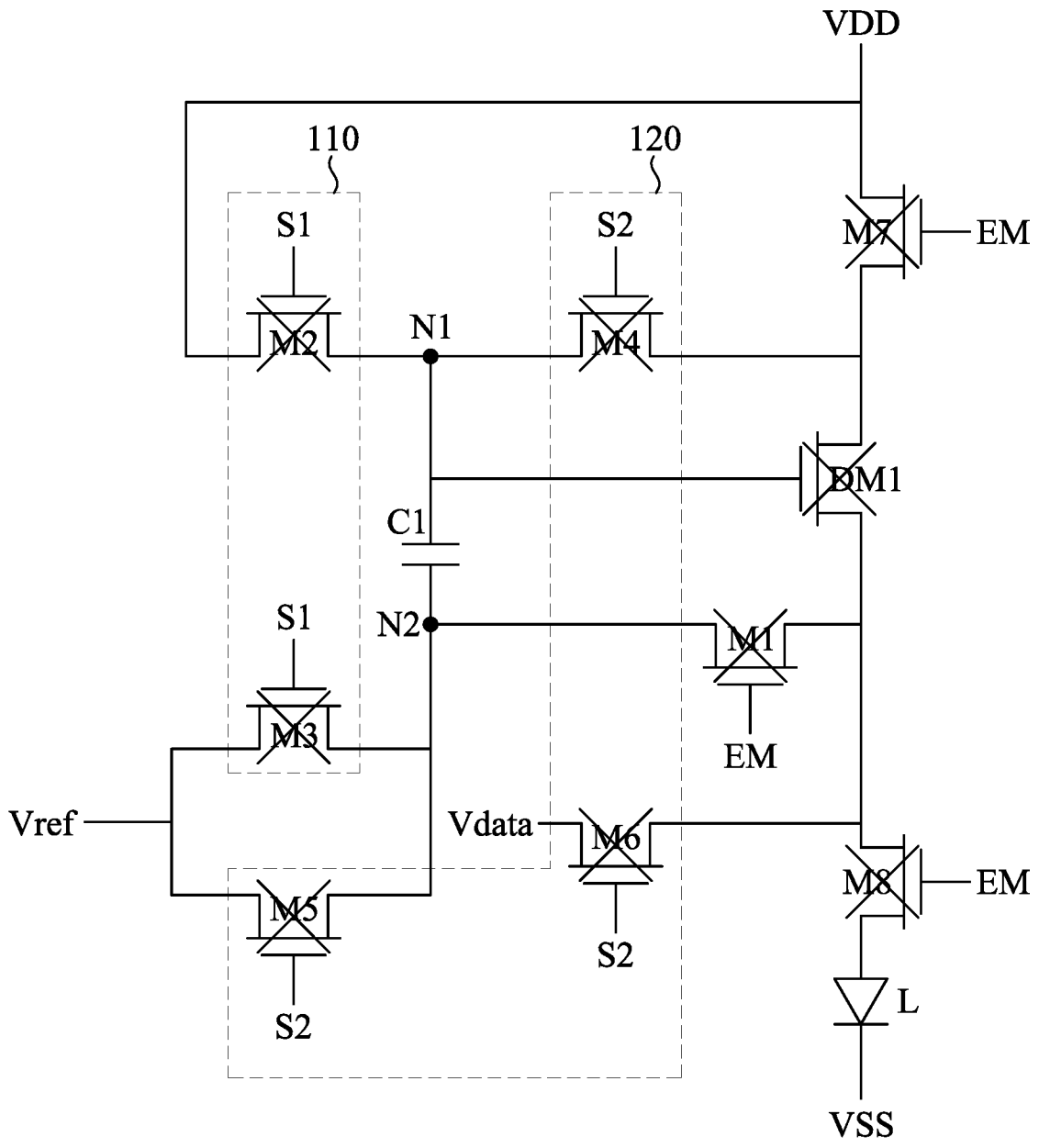
FIG. 7 depicts a state diagram of a pixel driving device according to some embodiments of the present disclosure.

In some embodiments, please prefer FIG. 2 and FIG. 7, in a fourth stage, each of the first sweep signal S1, the second sweep signal S2 and the control signal EM is at low level, and all of transistors of the pixel driving device100 are turned off to be reset.

Based on the above embodiments, the present disclosure provides a pixel driving device and a method for driving pixel so as to improve a difference of a threshold voltage of a transistor and solve a problem that a driving current is affected by a power supply voltage.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A pixel driving device, comprising:

a capacitor, comprising a first end and a second end;

a reset circuit, coupled to the first end and the second end of the capacitor;

a compensation circuit, coupled to the first end and the second end of the capacitor;

a driving transistor, comprising a first end, a second end, and a control end, wherein the control end of the driving transistor is coupled to the first end of the capacitor; and a first transistor, comprising a first end, a second end, and a control end, wherein each of the first end and the second end of the first transistor is coupled between the second end of the driving transistor and the second end of the capacitor;

wherein the reset circuit is configured to reset the first end of the capacitor to a power supply voltage, and reset the second end of the capacitor to a reference voltage according to a first sweep signal respectively in a first stage, wherein the compensation circuit is configured to write a data voltage into the first end of the capacitor via the driving transistor so that a voltage of the first end of the capacitor is at a first voltage, and the second end of the capacitor is maintained at the reference voltage according to a second sweep signal in a second stage, wherein the first transistor is configured to be turned on so as to generate a driving voltage difference between the first voltage of the first end of the capacitor and the reference voltage of the second end of the capacitor according to a control signal in a third stage, wherein the driving transistor is configured to output a driving current to a luminous element according to the driving voltage difference in the third stage.

2. The pixel driving device of claim 1, wherein the reset circuit comprises:

a second transistor, comprising a first end, a second end, and a control end, wherein the first end of the second transistor is electrically connected to the first end of the capacitor, wherein the second end of the second transistor is configured to receive the power supply voltage, wherein the control end of the second transistor is configured to reset the first end of the capacitor to the power supply voltage according to the first sweep signal in the first stage; and a third transistor, comprising a first end, a second end, and a control end, wherein the first end of the third transistor is electrically connected to the second end of the capacitor, wherein the second end of the third transistor is configured to receive the reference voltage, wherein the control end of the third transistor is configured to reset the second end of the capacitor to the reference voltage according to the first sweep signal in the first stage.

3. The pixel driving device of claim 2, wherein the compensation circuit comprises:

a fourth transistor, comprising a first end, a second end, and a control end, wherein the first end of the fourth transistor is electrically connected to the first end of the driving transistor, wherein the second end of the fourth transistor is electrically connected to the first end of the capacitor, wherein the control end of the fourth transistor is configured to write the data voltage into the first end of the capacitor via the driving transistor according to the second sweep signal in the second stage;

a fifth transistor, comprising a first end, a second end, and a control end, wherein the first end of the fifth transistor is electrically connected to the second end of the capacitor, wherein the second end of the fifth transistor is configured to receive the reference voltage, wherein the control end of the fifth transistor is configured to maintain the reference voltage at the second end of the capacitor according to the second sweep signal in the second stage; and a sixth transistor, comprising a first end, a second end, and a control end, wherein the first end of the sixth transistor is electrically connected to the second end of the driving transistor, wherein the second end of the sixth transistor is configured to receive the data voltage, wherein the control end of the sixth transistor is configured to write the data voltage into the first end of the capacitor via the driving transistor according to the second sweep signal in the second stage.

4. The pixel driving device of claim 3, further comprising:

a seventh transistor, comprising a first end, a second end, and a control end, wherein the first end of the seventh transistor is configured to receive the power supply voltage, wherein the second end of the seventh transistor is electrically connected to the first end of the driving transistor, wherein the control end of the seventh transistor is configured to be turned on so as to output the driving current to the luminous element according to the control signal in the third stage; and an eighth transistor, comprising a first end, a second end, and a control end, wherein the first end of the eighth transistor is electrically connected to the second end of the driving transistor, wherein the second end of the eighth transistor is electrically connected to the luminous element, wherein the control end of the eighth transistor is configured to be turned on to output the driving current to the luminous element according to the control signal in the third stage.

5. The pixel driving device of claim 4, wherein the control signal comprises a pulse width modulation signal, wherein a duty cycle of the pulse width modulation signal is adjustable.

6. A method for driving pixel, adapted for a pixel driving device, wherein the pixel driving device comprises a capacitor, a driving transistor, and a first transistor, wherein a control end of the driving transistor is coupled to a first end of the capacitor, wherein each of a first end and a second end of the first transistor is coupled to a second end of the capacitor and a second end of the driving transistor respectively, wherein the method for driving pixel comprises:

resetting the first end of the capacitor to a power supply voltage, and resetting the second end of the capacitor to a reference voltage according to a first sweep signal respectively in a first stage;

writing a data voltage into the first end of the capacitor so that a voltage of the first end of the capacitor is at a first voltage and the second end of the capacitor is maintained at the reference voltage via the driving transistor according to a second sweep signal in a second stage;

turning on the first transistor to generate a driving voltage difference between the first voltage of the first end of the capacitor and the reference voltage of the second end of the capacitor according to a control signal in a third stage; and outputting a driving current to a luminous element according to the driving voltage difference in the third stage.

7. The method for driving pixel of claim 6, wherein resetting the first end of the capacitor to the power supply voltage, and resetting the second end of the capacitor to the reference voltage according to the first sweep signal respectively in the first stage comprises:

resetting the first end of the capacitor to the power supply voltage via a reset circuit according to the first sweep signal; and resetting the second end of the capacitor to the reference voltage via the reset circuit according to the first sweep signal.

8. The method for driving pixel of claim 6, wherein writing the data voltage into the first end of the capacitor so that the voltage of the first end of the capacitor is at the first voltage and the second end of the capacitor is maintained at the reference voltage via the driving transistor according to the second sweep signal in the second stage comprises:

writing the data voltage into the first end of the capacitor through the driving transistor via compensation circuit according to the second sweep signal so that the voltage of the first end of the capacitor is at the first voltage, and the second end of the capacitor is maintained at the reference voltage.

9. The method for driving pixel of claim 6, wherein turning on the first transistor to generate the driving voltage difference between the first voltage of the first end of the capacitor and the reference voltage of the second end of the capacitor according to the control signal in the third stage comprises:

turning on the first transistor according to the control signal to rewrite the reference voltage of the second end of the capacitor as the voltage of the second end of the driving transistor so as to rise up a voltage level of the first end of the capacitor.

10. The method for driving pixel of claim 6, wherein outputting the driving current to the luminous element according to the driving voltage difference in the third stage comprises:

outputting the driving current to the luminous element according to a pulse width modulation signal and the driving voltage difference, wherein a duty cycle of the pulse width modulation signal is adjustable.

* * * * *